US007211757B2

(12) United States Patent
Maehara

(10) Patent No.: US 7,211,757 B2
(45) Date of Patent: May 1, 2007

(54) PUSH SLIDE SWITCH

(75) Inventor: Masataka Maehara, Tokyo (JP)

(73) Assignee: SMK Corporation, Tokyo (JP)

( * ) Notice: Subject to any disclaimer, the term of this patent is extended or adjusted under 35 U.S.C. 154(b) by 102 days.

(21) Appl. No.: 11/135,598

(22) Filed: May 23, 2005

(65) Prior Publication Data

US 2005/0263384 A1 Dec. 1, 2005

(30) Foreign Application Priority Data

May 25, 2004 (JP) ..... 2004-154586

(51) Int. Cl.
*H01H 5/00* (2006.01)

(52) U.S. Cl. ..... 200/405; 200/408; 200/16 A; 200/1 B

(58) Field of Classification Search .... 200/16 R–16 D, 200/405–408, 445, 447, 449, 520, 521, 534–536, 200/1 B, 547, 549, 550
See application file for complete search history.

(56) References Cited

U.S. PATENT DOCUMENTS 4,359,614 A * 11/1982 Green et al. ..... 200/5 R
5,898,147 A * 4/1999 Domzalski et al. ..... 200/1 B
6,262,383 B1 * 7/2001 Nishikawa ..... 200/406
6,483,058 B2 * 11/2002 Ehrensberger ..... 200/302.2
6,639,159 B2 * 10/2003 Anzai ..... 200/1 B
6,670,566 B1 * 12/2003 Wang ..... 200/406
6,815,628 B2 * 11/2004 Okita et al. ..... 200/406

FOREIGN PATENT DOCUMENTS

JP 2000-311511 11/2000
JP 2001-229781 8/2001

* cited by examiner

*Primary Examiner*—Michael A. Friedhofer
(74) *Attorney, Agent, or Firm*—Pearne & Gordon LLP

(57) ABSTRACT

For a push slide switch in which as a knob is slid, terminals and are electrically connected, click springs and are provided, which have a characteristic that as displacement level is increased, stress increases, and as the displacement level is more increased, the stress decreases sharply. The click springs and are arranged so that force necessary for operation of the knob decreases sharply when the terminals are electrically connected.

18 Claims, 8 Drawing Sheets

5D
1C
1A
1
1G

5B
C
5A
5C
1
1F
1E
D
D
5D
1G
5E
5F
C
5G 5B
1B
1
1A
1D
5F

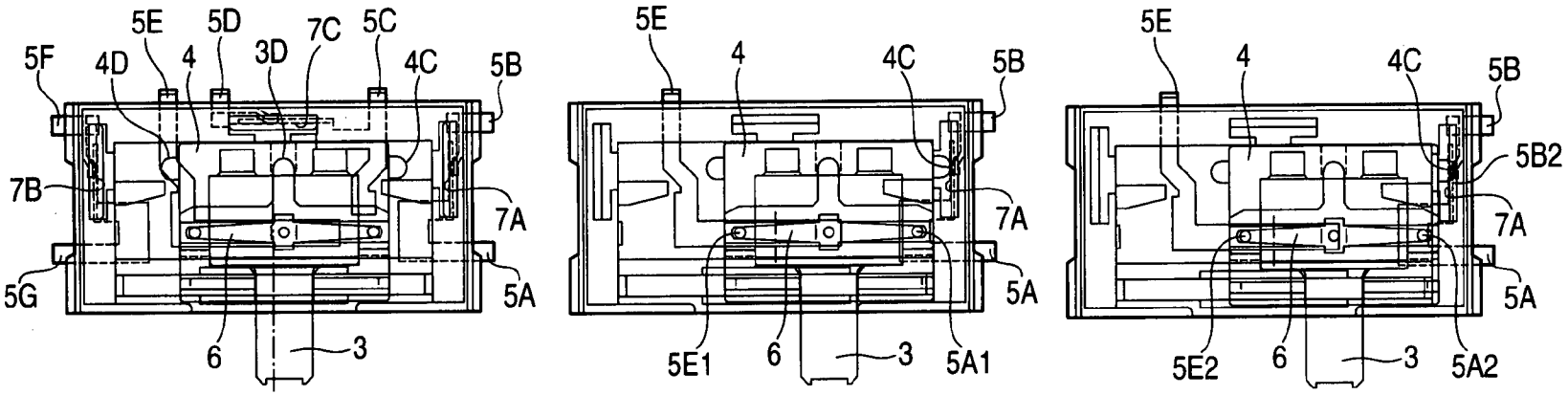
FIG. 6C
FIG. 6B
FIG. 6A
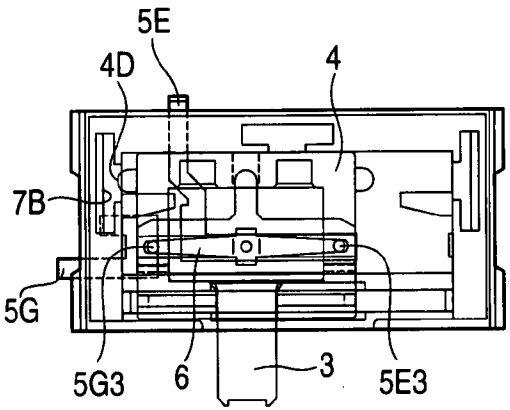
FIG. 6D
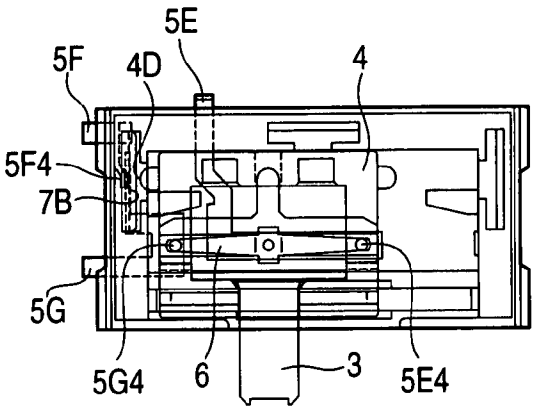
FIG. 6E

PUSH SLIDE SWITCH

BACKGROUND OF THE INVENTION

The present invention relates to a slide switch in which as a knob is slid, terminals are connected electrically, and particularly to a slide switch which causes an operator to recognize that the terminals are electrically connected more effectively than in a case that a knob is abutted against an abutting part.

Further, the invention relates to a slide switch and a push slide switch, in which as a knob is slid, terminals are connected electrically, and particularly to a slide switch and a push slide switch, in which connection states of more terminals than terminals in the related case can be switched by a slide operation of the knob.

Heretofore, a push slide switch in which as a knob is slid, terminals are connected electrically, has been known. An example of this type of push slide switch has been disclosed in JP-A-2001-229781.

A push slide switch described in JP-A-2001-229781 is so constituted that: as a knob is slid, a coil spring is compressed; and as an operator releases the knob, the knob returns to a neutral position (home position) by the restoring force of the coil spring. Namely, in the push slide switch described in JP-A-2001-229781, as the knob is slide, the force necessary for operation of the knob increases gradually, and when terminals are electrically connected, the force necessary for operation of the knob does not change greatly. Therefore, the operator cannot recognize, by the change of the force necessary for operation of the knob, that the terminals have been electrically connected.

Therefore, in the related arts, when the terminals have been electrically connected, the knob is directly or indirectly abutted against an abutting part so that the operator can recognize that the terminals have been electrically connected. Namely, in the related arts, by other methods than the method in which the knob is directly or indirectly abutted against the abutting part, the operator cannot recognize that the terminals have been electrically connected.

Further, in the push slide switch described in JP-A-2001-229781, as the knob is slid from the neutral position (home position) to the right side, one terminals are electrically connected, and as the knob is slid from the neutral position (home position) to the left side, the other terminals are electrically connected. Namely, in the push slide switch described in JP-A-2001-229781, a state in which the knob is arranged in the neutral position (home position) and the terminals are not electrically connected, a state in which the knob is slid from the neutral position (home position) to the right side, and one terminals are electrically connected, and a state in which the knob is slid from the neutral position (home position) to the left side, and the other terminals are electrically connected are switched by the slide operation of the knob.

Namely, in the push slide switch described in JP-A-2001-229781, there are three connection states of the terminals, which can be switched by the slide operation of the knob, but four or more connection states of the terminals cannot be switched by the slide operation of the knob.

Patent Reference 1: JP-A-2001-229781

SUMMARY OF THE INVENTION

In view of the above problems, an object of the invention is to provide a slide switch which can cause an operator to recognize that terminals have been electrically connected more effectively than in case that a knob is abutted against an abutting part.

Further, another object of the invention is to provide a slide switch and a push slide switch which can switch more connection states of terminals than the related connection states by slide operation of the knob.

In order to accomplish the above object, a push slide switch of the present invention is characterized by having the following arrangement:

(1) A slide switch comprising:
- a housing;
- a knob that is slidably provided in the housing;
- a plurality of terminals that are disposed in the housing; and
- a click spring that is disposed in the housing, and has a characteristic that as a displacement level thereof is increased, stress thereof increases, and as the displacement level is more increased, the stress decreases sharply,
- wherein the click spring is arranged so that force for operating the knob decreases sharply when the terminals are electrically connected each other.

(2) A slide switch according to (1),
- wherein the click spring is arranged so that:
- when the knob is slid in a direction and abuts against the click spring directly or indirectly, the force increases sharply with its abutting, and a first group of the terminals are electrically connected each other;
- when the knob is slid more in the direction, the force increases more and reaches a peak; and
- when the force decrease sharply, a second group of the terminals are electrically connected each other.

(3) A slide switch according to (1),
- wherein when the knob is slid in a first direction from a home position of the housing, which is a substantially center position in the direction, a first group of the terminals are electrically connected each other,
- when the knob is slid more in the first direction, a second group of the terminals are electrically connected each other,
- when the knob is slid in a second direction opposed to the first direction from the home position, a third group of the terminals are electrically connected each other, and
- when the knob is slid more in the second direction, a forth group of the terminals are electrically connected each other.

(4) A slide switch according to (3),
- wherein when the knob is push-moved in a third direction perpendicular to the first direction from the home position, a fifth group of the terminals are electrically connected each other, and
- when the knob is push-moved more in the third direction, a sixth group of the terminals are electrically connected each other.

(5) A slide switch according to (4),
- wherein the housing includes a plurality of the click spring, and
- wherein the click springs are arranged so that force for operating the knob in the third direction in order to connect the sixth group of the terminals becomes larger than force for operating the knob in the first direction in order to connect the second group of the terminals and in the second direction in order to connect the forth group of the terminals.

(6) A slide switch according to (1), wherein the click spring is arranged on a wall surface of the housing, which is perpendicular to a direction in which the knob is slid.

(7) A slide switch according to (6), wherein the wall surface is inclined with respect to a bottom surface of the housing, which is parallel to the direction.

(8) A slide switch comprising:

a housing;

a knob that is slidably provided in the housing; and a first switching unit that includes:

a first group of terminals that are disposed in the housing; and a click spring that is arranged in the housing, wherein the knob is slidable in a sliding direction from a home position of the housing, which is a substantially center position in the sliding direction, to first and second positions that are arranged in this order from the home position to the click spring in the sliding direction, wherein when the knob abuts against the click spring, force for operating the knob increases sharply, wherein when the knob is moved from the first position to the second position, the force decrease sharply, and the first group of the terminals are electrically connected each other.

(9) A slide switch according to (8), wherein the first switching unit includes a second group of terminals that are disposed in the housing wherein a third position, at which the knob abuts against the click spring, is set between the home and first positions, wherein when the knob abuts against the click spring and is set at the third position, the force increases sharply, and the second group of the terminals are electrically connected each other, wherein when the knob is moved from the third position to the first position, the force increases more, and wherein when the knob is moved from the first position to the second position, the force decrease sharply, and the first group of the terminals are electrically connected each other.

(10) A slide switch according to (9), further comprising a second switching unit having a same structure as the first switching unit, the second switching unit being disposed opposite to the first switching unit with respect to the home position.

(11) A slide switch according to (10), further comprising a third switching unit having the same structure as the first switching unit, the third switching unit being disposed between the first and second switching units.

(12) A slide switch according to (11), wherein the knob is slidable in a direction perpendicular to the sliding direction.

(13) A slide switch according to (12), wherein the click springs are arranged so that the force for operating the knob in the direction in order to connect the first group of the terminals of the third switching unit becomes larger than the force for operating the knob in the sliding direction in order to connect the first groups of the terminals of the first and second switching units.

(14) A slide switch according to (8), wherein the click spring is arranged on a wall surface of the housing, which is perpendicular to a direction in which the knob is slidable.

(15) A slide switch according to (14), wherein the wall surface is inclined with respect to a bottom surface of the housing, which is parallel to the direction.

(16) A slide switch according to (9), wherein at least one of the terminals of the first group is common to at least one of the terminals of the second group.

In the slide switch according to the present invention, the click spring having the characteristic that as the displacement level is increased, the stress increases, and as the displacement level thereof is more increased, the stress thereof decreases sharply is provided. The click spring is arranged so that the force for operating the knob decreases sharply when the terminals are electrically connected. Therefore, by the sharp decrease of the force for operating the knob the operator can recognize that the terminals have been electrically connected. Namely, the operator can recognize more effectively that the terminals are electrically connected than in a case that the knob is abutted against the abutting part.

Preferably, by drawing, for example, a plate spring, the click spring is formed. Specifically, the click spring has a characteristic that: as a drawn convex part is recessed, stress increases, and as the drawn convex part is more recessed, the stress decreases sharply.

In the slide switch according to the present invention, the click spring is arranged so that: when the knob is slid from the home position in some direction and abuts against the click spring directly or indirectly, the force for operating the knob increases sharply with its abutting, and the first terminals are electrically connected; when the knob is slid more in that direction, the force for operating the knob increases more and reaches a peak; and next when the force decrease sharply, the second terminals are electrically connected. Namely, the click spring is arranged so that the force necessary for operation of the knob decreases sharply when the second terminals are electrically connected. Therefore, by the sharp decrease of the force for operating the knob, the operator can recognize that the second terminals have been electrically connected. Namely, the operator can recognize more effectively that the second terminals have been electrically connected than in a case that the knob is abutted against the abutting part.

Specifically, when the knob is not operated and is located in the home position, the terminals are not connected electrically, when the knob is slid and abutted against the click spring directly or indirectly, the force for operating the knob increases sharply, and the first terminals are electrically connected; and when the knob is slid more and the force for operating the knob decreases sharply, the second terminals are electrically connected. Therefore, by providing the state where the knob is not operated, the state where the force for operating the knob increases sharply, and the state where the force for operating the knob decreases sharply, three states; a state where the terminals are not connected electrically, a state where the first terminals are electrically connected, and a state where the second terminals are electrically connected can be recognized by the operator.

In the slide switch according to the third aspect, when the knob is slid from the home position in the first direction, for example, to the right, the first terminals are electrically connected; when the knob is slid more in the first direction, the second terminals are electrically connected; when the knob is slid from the home position in the second direction that is opposed to the first direction, for example, to the left, the third terminals are electrically connected; and when the knob is slid more in the second direction, the fourth terminals are electrically connected. Namely, a state where the knob is arranged in the home position and the terminals are not connected electrically, a state where the knob is slid in the first direction and the first terminals are electrically connected, a state where the knob is slid more in the first direction and the second terminals are electrically connected, a state where the knob is slid in the second direction and the third terminals are electrically connected, and a state where the knob is slid more in the second direction and the fourth terminals are electrically connected are switched by the slide operation of the knob. Namely, five terminal connection states are switched by the slide operation of the knob. Therefore, compared with the related case, many terminal connection states can be switched by the slide operation of the knob.

In the push slide switch according to the present invention, when the knob is push-moved from the home position in the third direction perpendicular to the first direction, the fifth terminals are electrically connected, and when the knob is push-moved more in the third direction, the sixth terminals are electrically connected. Namely, the state where the knob is push-moved in the third direction and the fifth terminals are electrically connected, and the state where the knob is push-moved more in the third direction and the sixth terminals are electrically connected, are switched by the push operation of the knob. Therefore, by the slide operation and the push operation of the knob, the seventh states can be switched.

For example, when the first terminals are electrically connected, an item included in a first menu is scrolled and selected; when the second terminals are electrically connected, its selected item is determined; when the third terminals are electrically connected, an item included in a second menu is scrolled and selected; when the fourth terminals are electrically connected, its selected item is determined; when the fifth terminals are electrically connected, an item included in a third menu is scrolled and selected; and when the sixth terminals are electrically connected, its selected item is determined, whereby selection and determination operations of three menus can be executed by one knob.

In the slide switch according to the present invention, the click spring is arranged on the wall surface of the slide switch housing. Therefore, the width of the slide switch can be made smaller than that in a case that the click spring is arranged on the bottom surface of the slide switch housing. Further, larger slide stroke of the knob than that in a case that the click spring is arranged on the bottom surface of the slide switch housing can be secured. In result, midway of the slide stroke of the knob, another terminal can be provided.

For example, in case that the slide switch housing is formed by molding, and its drawn direction is perpendicular to the bottom surface of the slide switch housing, when we try to insert-mold the terminal in the wall surface standing perpendicularly to the bottom surface of the slide switch housing, the structure of a mold for insert-molding the terminal becomes complicated, so that cost of the mold increases. In consideration of this point, in the slide switch according to the present invention, the click spring is arranged on the wall surface that is inclined with respect to the bottom surface of the slide switch housing. Preferably, the click spring is arranged on the wall surface standing at an angle of less than 90° to the bottom surface of the slide switch housing, and more preferably, the click spring is arranged on the wall surface standing at an angle of 60° to 85°. Specifically, on its inclined standing wall surface, the terminal is insert-molded. Therefore, the structure of the mold for molding the slide switch housing can be simplified more than that in case that the click spring is arranged on the wall surface standing perpendicularly to the bottom surface of the slide switch housing, and the terminal is insert-molded in its wall surface. In result, the molding cost of the slide switch housing can be held. Specifically, without providing the slide structure for the mold for the slide switch housing, the terminal can be insert-molded. Further, since the click spring is arranged on the wall surface being inclined with respect to the bottom surface of the slide switch housing, contact property of the click spring can be improved.

In the push slide switch according to the present invention, another click spring is arranged so that the force to push-move the knob in the third direction in order to connect the sixth terminals electrically becomes larger than the force to push-move the knob in the first direction in order to connect the second terminals electrically, and the force to push-move the knob in the second direction in order to connect the fourth terminals electrically. Therefore, when the knob is push-moved in the first direction or the second direction, it is possible to prevent the sixth terminals from being electrically connected erroneously. Preferably, elastic coefficient of the click spring for causing the operator to recognize that the sixth terminals have been electrically connected is set to a larger value than elastic coefficient of the click spring for causing the operator to recognize that the second terminals have been electrically connected, and elastic coefficient of the click spring for causing the operator to recognize that the fourth terminals have been electrically connected.

BRIEF DESCRIPTION OF THE DRAWINGS

FIGS. 6A to 6E are diagrams showing the state where the knob 3 is slid in the left and right directions in FIGS. 1A and 4A.

DETAIL DESCRIPTION OF PREFERRED EMBODIMENTS

Figure 1C:
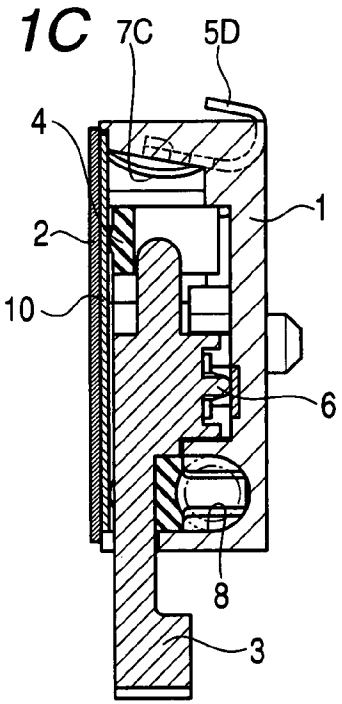
FIGS. 1A to 1C are diagrams showing a first embodiment of a push slide switch of the invention.
Figure 1A:
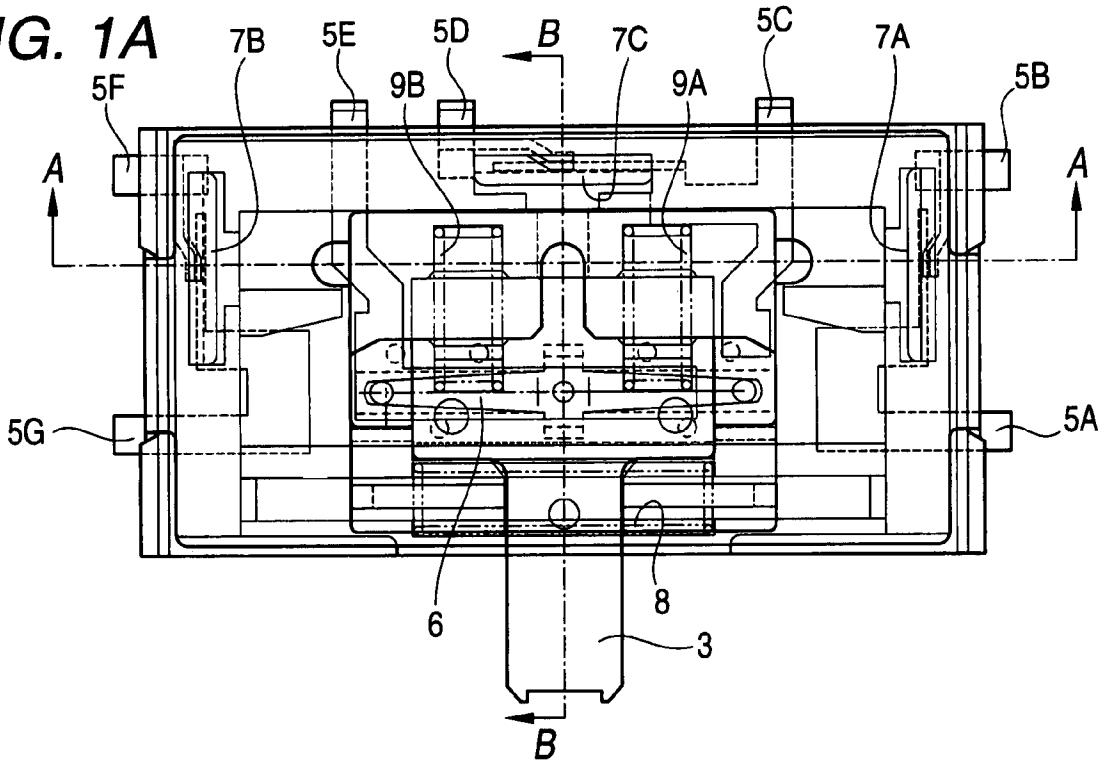
Figure 1B:
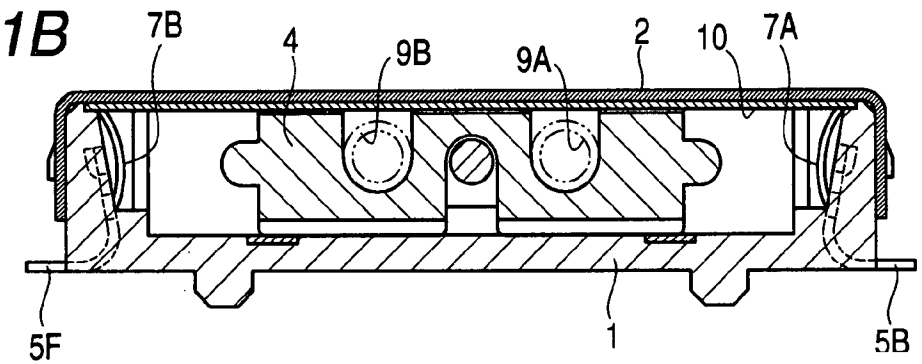

FIGS. 1A to 1C are diagrams showing a first embodiment of a push slide switch of the invention. Specifically, FIG. 1A is a plan view of the push slide switch in the first embodiment, FIG. 1B is a sectional view taken along a line A—A of FIG. 1A, and FIG. 1C is a sectional view taken along a line B—B of FIG. 1A.

In FIG. 1, reference numeral 1 is a housing of the push slide switch. This housing 1 is formed by molding, for example, resin material. Reference numeral 2 is a cover for covering the inside of the housing 1. This cover 2 is formed of, for example, metal material. Reference numeral 3 is a knob constituted so that an operator of the push slide switch can slide the knob in left and right directions of FIG. 1A, and can push the knob upward. This knob 3 is formed of, for example, resin material. Reference numeral 4 is a slider which is constituted so that it can slide integrally with the knob 3 in the left and right directions of FIG. 1A. This slider 4 is formed of, for example, resin material. Reference numerals 5A, 5B, 5C, 5D, 5E, 5F, and 5G are terminals formed of conductive materials. These terminals 5A, 5B, 5C, 5D, 5E, 5F, and 5G are fixed to the housing 1 by, for example, insert-molding. Reference numeral 6 is a contact piece formed of conductive material. This contact piece 6 is attached to the knob 3, and so constituted as to move integrally with the knob 3.

Figure 8A:
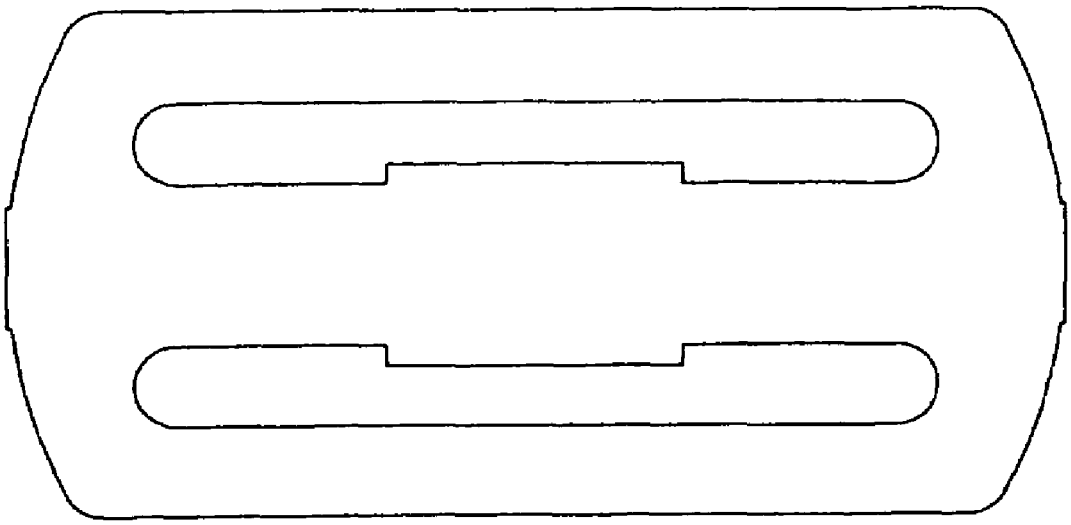
FIGS. 8A and 8B are enlarged views of a click spring 7A, 7B, or 7C shown in FIGS. 1A to 1C.
Figure 8B:
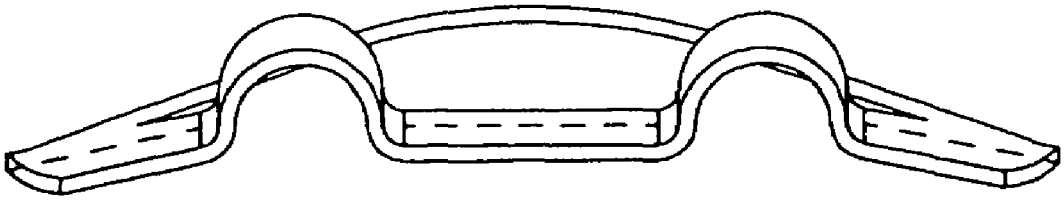

Reference numerals 7A, 7B, and 7C are click springs dome-shaped (shaped convexly) by drawing a conductive plate spring material. FIG. 8 is an enlarged view of the click spring 7A, 7B, or 7C shown in FIG. 1. Specifically, FIG. 8A is a plan view of the click spring 7A, 7B, 7C, and FIG. 8B is a front view of the click spring 7A, 7B, 7C. These click springs 7A, 7B, and 7C have a characteristic that as displacement level (elastic deformation level, recess level) thereof is increased, stress thereof increases, and as the displacement level (elastic deformation level, recess level) is more increased, the stress decreases sharply. Namely, these click springs 7A, 7B, and 7C have a characteristic that as a convex part (upper portion of the click spring shown in FIG. 8B) is recessed, force necessary to recess the convex part increases, and as the convex part is more recessed, the force necessary to recess the convex part decrease sharply. Eventually, these click springs 7A, 7B, and 7C are constituted so that an operator of the push slide switch can obtain a click feeling when the force necessary to recess the click springs 7A, 7B, and 7C decreases sharply.

The click spring 7A is electrically connected to the terminal 5A. Further, the click spring 7A, when it is recessed till the force necessary to recess the click springs decreases sharply, is electrically connected also to the terminal 5B arranged on the back surface of the click spring 7A. Further, the click spring 7B is electrically connected to the terminal 5G Further, the click spring 7B, when it is recessed till the force necessary to recess the click springs decreases sharply, is electrically connected also to the terminal 5F arranged on the back surface of the click spring 7B. Furthermore, the click spring 7C is electrically connected to the terminal 5C. Further, the click spring 7C, when it is recessed till the force necessary to recess the click springs decreases sharply, is electrically connected also to the terminal 5D arranged on the back surface of the click spring 7C.

Reference numeral 8 is a coil spring for returning the knob 3 and slider 4 which are slid to the right side in FIG. 1A to a position (home position) shown in FIG. 1A, and returning the knob 3 and slider 4 which are slid to the left side in FIG. 1A, to the home position. Reference numerals 9A and 9B are coil springs for returning the knob 3 which is pushed upward in FIG. 1A to the home position. Reference numeral 10 is an insulating sheet arranged inside the cover 2.

Figures 2A, 2B, 2C:
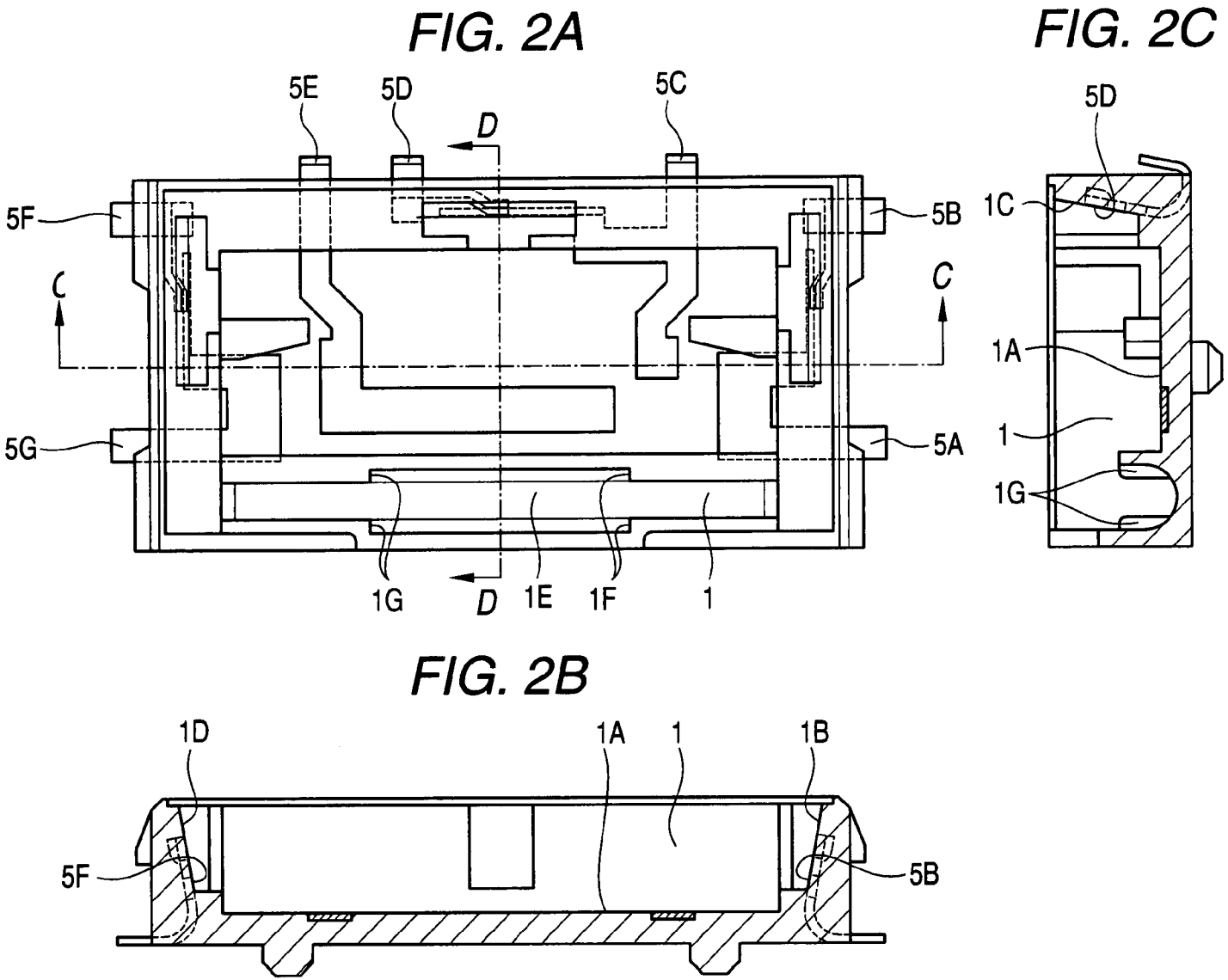
FIGS. 2A to 2C are enlarged part drawings of a housing 1 and terminals 5A, 5B, 5C, 5D, 5E, 5F, 5G shown in FIGS. 1A to 1C.

FIGS. 2A to 2C are enlarged part drawings of the housing 1 and the terminals 5A, 5B, 5C, 5D, 5E, 5F, 5G shown in FIGS. 1A to 1C. Specifically, FIG. 2A is a plan view of the housing 1 and the terminals 5A, 5B, 5C, 5D, 5E, 5F, 5G; FIG. 2B is a sectional view taken along a line C—C of FIG. 2A; and FIG. 2C is a sectional view taken along a line D—D of FIG. 2A. In FIGS. 2A to 2C, reference numeral 1A is a bottom surface of the housing 1, and reference numerals 1B, 1C, and 1D are wall surfaces standing from the bottom surface 1A of the housing 1. Reference numeral 1E is a coil spring housing part for housing the coil spring 8 shown in FIGS. 1A and 1C, and reference numerals 1F and 1G are coil spring supporting parts for supporting both ends of the coil spring 8.

Figure 3C:
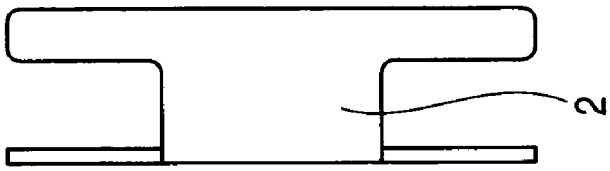
FIGS. 3A to 3C are enlarged part drawings of a cover 2 shown in FIGS. 1A to 1B.
Figure 3A:
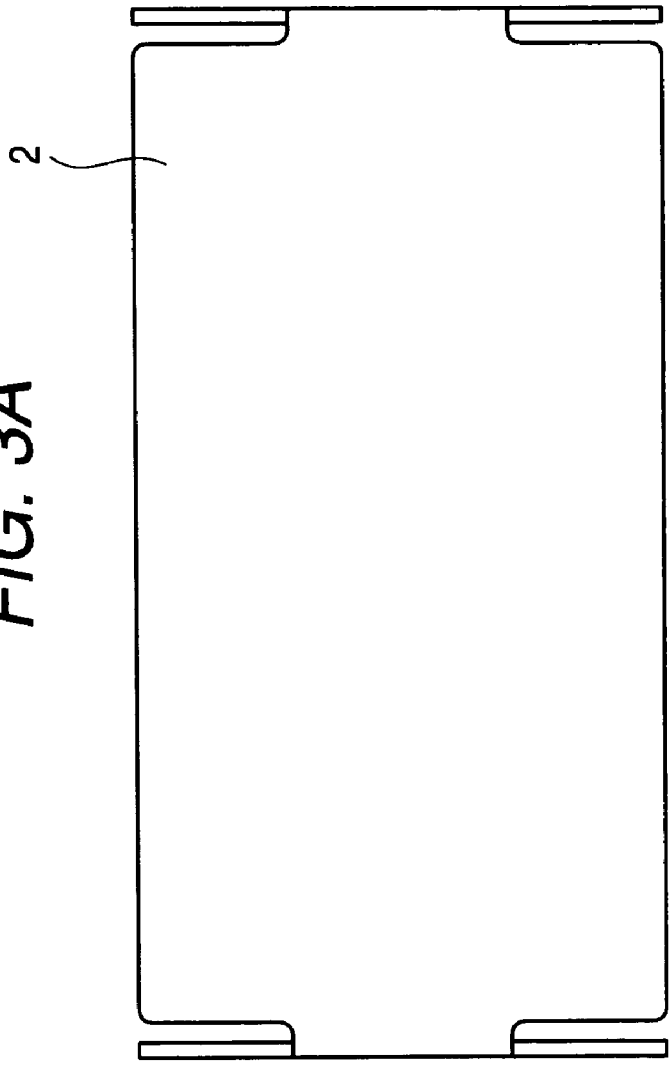
Figure 3B:
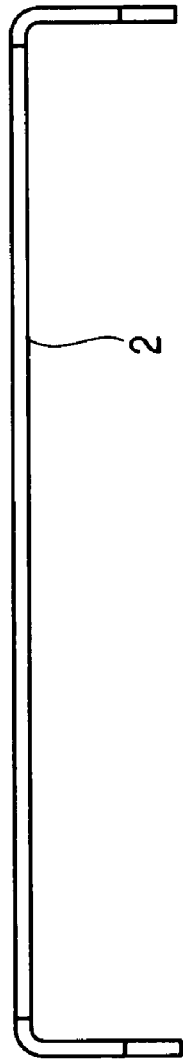

FIGS. 3A to 3C are enlarged part drawings of the cover 2 shown in FIGS. 1A to 1B. Specifically, FIG. 3A is a plan view of the cover 2; FIG. 3B is a front view of the cover 2, and FIG. 3C is a right side view of the cover 2.

Figure 4E:
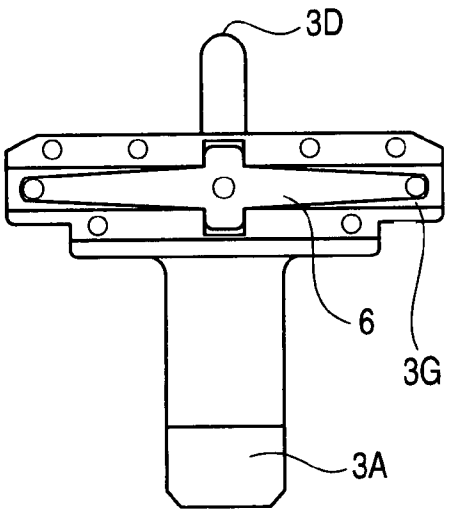
FIGS. 4A to 4E are enlarged part drawings of a knob 3 and a contact piece 6 shown in FIGS. 1A to 1C.
Figure 4D:
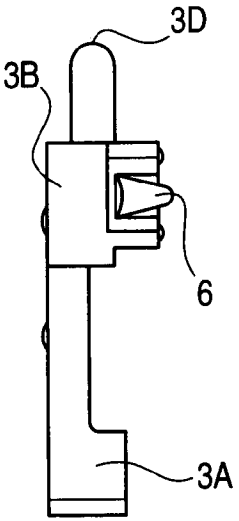
Figure 4C:
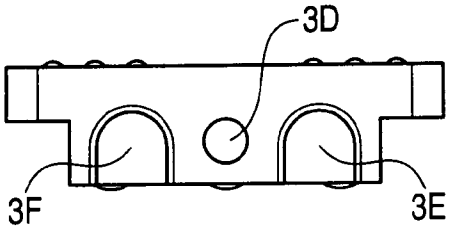
Figure 4A:
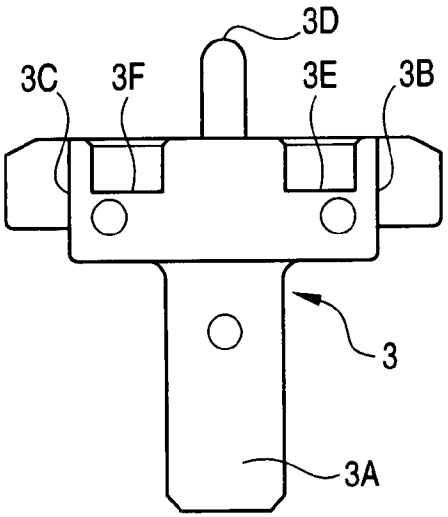
Figure 4B:
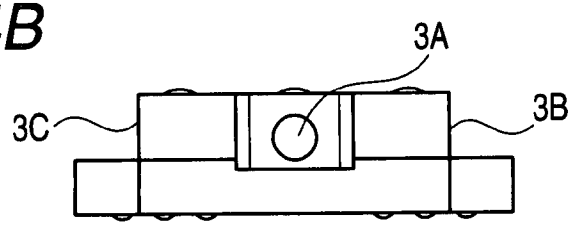

FIGS. 4A to 4E are enlarged part drawings of the knob 3 and the contact piece 6 shown in FIGS. 1A and 1C. Specifically, FIG. 4A is a plan view of the knob 3, FIG. 4B is a front view of the knob 3, FIG. 4C is a rear side view of the knob 3, FIG. 4D is a right side view of the knob 3 and the contact piece 6, and FIG. 4E is a back view of the knob 3 and the contact piece 6. In FIG. 4, reference numeral 3A is a grip part for putting the operator's finger on the knob 3 of the push slide switch. Reference numeral 3B is a contact surface for push-moving the slider 4 so as that the slider 4 is slid to the right in FIGS. 1A and 4A integrally with the knob 3 when the knob 3 is slid to the right in FIGS. 1A and 4A. FIG. 3C is a contact surface for push-moving the slider 4 so that the slider 4 is slid to the left in FIGS. 1A and 4A integrally with the knob 3 when the knob 3 is slid to the left in FIGS. 1A and 4A. Referring numeral 3D is a projection for recessing the convex click spring 7C, that is, for elastically deforming the click spring 7C. Reference numeral 3E is a coil spring holding part for supporting an end of the coil spring 9A, and reference numeral 3F is a coil spring holding part for supporting an end of the coil spring 9B. Reference numeral 3G is a contact piece inserting part for arranging the contact piece 6.

Figures 5A, 5B, 5C, 5D, 5E, 5F:
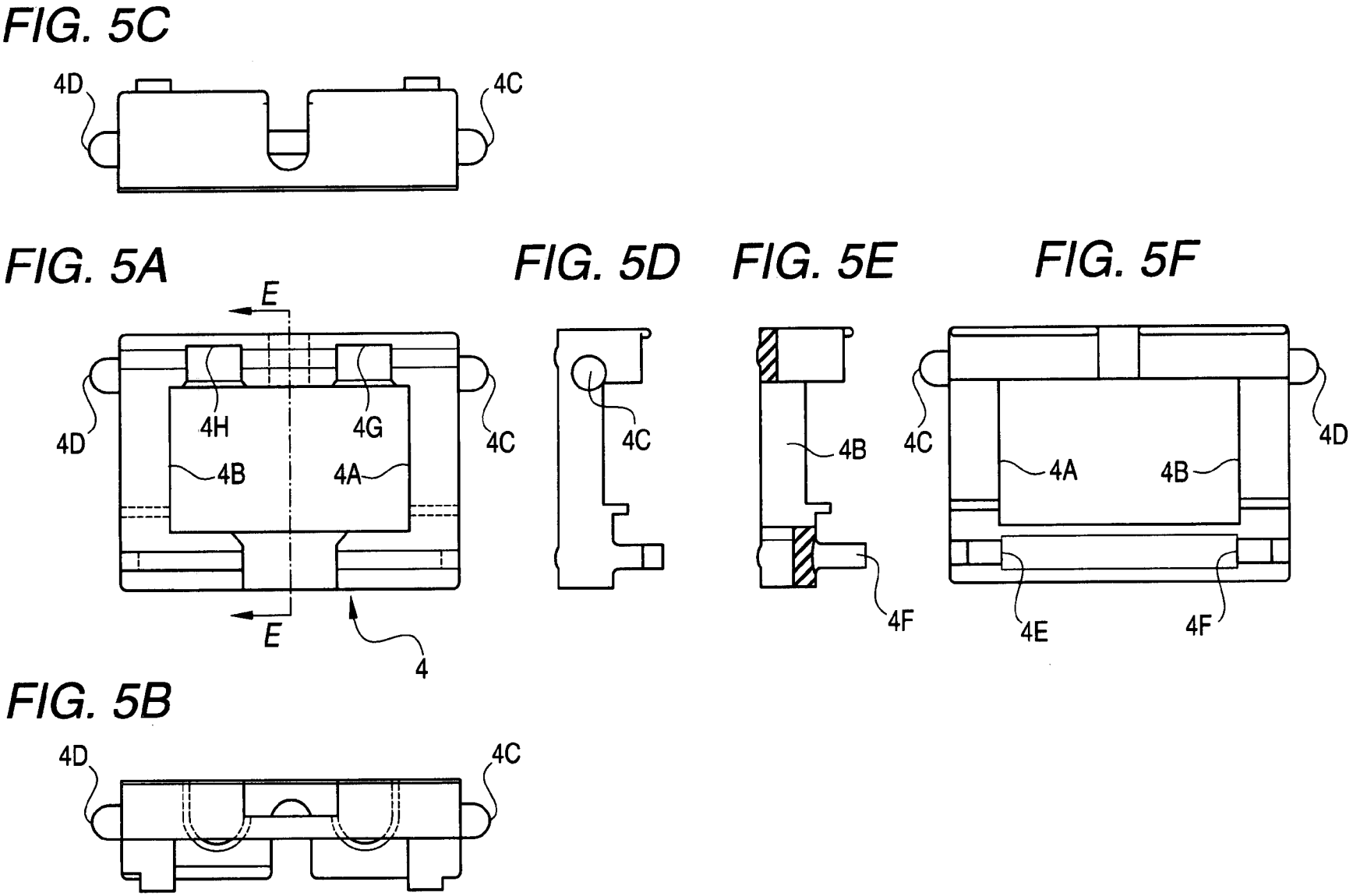
FIGS. 5A to 5F are enlarged part drawings of a slider 4 shown in FIGS. 1A to 1C.

FIGS. 5A to 5F are enlarged part drawings of the slider 4 shown in FIGS. 1A to 1C. Specifically, FIG. 5A is a plan view of the slider 4, FIG. 5B is a front view of the slider 4, FIG. 5C is a rear side view of the slider 4, FIG. 5D is a right side view of the slider 4, FIG. 5E is a sectional view taken along a line E—E of FIG. 5A, and FIG. 5F is a back view of the slider 4. In FIG. 5, reference numeral 4A is a contact surface which is push-moved by the contact surface 3B of the knob 3 so that the slider 4 is slid to the right in FIGS. 1A, 4A, and 5A integrally with the knob 3 when the knob 3 is slid to the right in FIGS. 1A, 4A and 5A. Reference numeral 4B is a contact surface which is push-moved by the contact surface 3C of the knob 3 so that the slider 4 is slid to the left in FIGS. 1A, 4A and 5A integrally with the knob 3 when the knob 3 is slid to the left in FIGS. 1A, 4A and 5A. Reference numeral 4C is a projection for recessing the convex click spring 7A, that is, for electrically deforming the click spring 7A. Reference numeral 4D is a projection for recessing the convex click spring 7B, that is, for electrically deforming the click spring 7B. Reference numeral 4E and 4F are coil spring holding parts for supporting both ends of the coil spring 8. Reference numeral 4G is a coil spring holding part for supporting an upper end (refer to FIG. 1A) of the coil spring 9A, and reference numeral 4H is a coil spring holding part for supporting an upper end (refer to FIG. 1A) of the coil spring 9B.

FIGS. 6A to 6E are diagrams showing the state where the knob 3 is slid in the left and right directions in FIGS. 1A and 4A. Specifically, FIG. 6A is a diagram showing the push slide switch when the knob 3 is arranged in the home position, that is, when the operator does not operate the knob 3. FIG. 6B is a diagram showing the push slide switch when the knob 3 is slid to the right side in FIGS. 1A, 4A, and 6A till the projection 4C of the slider 4 abuts against the click spring 7A. FIG. 6C is a diagram showing the push slide switch when the knob 3 is more slid to the right side in FIGS. 1A, 4A, and 6B till the force necessary for the slide operation of the knob 3 decreases sharply. FIG. 6D is a diagram showing the push slide switch when the knob 3 is slid to the left side in FIGS. 1A, 4A, and 6A till the projection 4D of the slider 4 abuts against the click spring 7B. FIG. 6E is a diagram showing the push slide switch when the knob 3 is more slid to the left side in FIGS. 1A, 4A, and 6D till the force necessary for the slide operation of the knob 3 decreases sharply.

In the state shown in FIG. 6A, that is, in the state where the knob 3 is arranged in the home position, the contact piece 6 is not brought into contact with other terminals 5A, 5B, 5C, 5D, 5F, and 5G than the terminal 5E. Namely, the terminals 5A, 5B, 5C, 5D, 5E, 5F, and 5G are separated electrically from one another, and the terminals 5A, 5B, 5C, 5D, 5E, 5F, and 5G are disconnected electrically to one another. In this state, a right end part of the coil spring 8 is supported by the coil spring holding part 1F of the housing 1, and a left end part of the coil spring 8 is supported by the coil spring holding part 1G of the housing 1.

Next, when the knob 3 is slid from the state shown in FIG. 6A to the right in FIG. 6A, the slider 4 is also slid to the right in FIG. 6A integrally with the knob 3. Hereby, the coil spring 8 starts to be compressed. Specifically, the coil spring 8 comes to be supported by the coil spring holding part 1F of the housing 1 and the coil spring holding part 4F of the slider 4. Namely, the right end part of the coil spring 8 comes to be supported by the coil spring holding part 1F of the housing 1, and the left end part of the coil spring 8 comes to be supported by the coil spring holding part 4F of the slider 4. As the knob 3 continues to slide to the right in FIG. 6A, the force necessary for the slide operation of the knob 3 increases gradually with increase of the slide quantity of the knob 3.

When the knob 3 continues to slide more to the right in FIG. 6A, the right end part of the contact piece 6 attached to the knob 3 is brought into contact with the terminal 5A. In other words, the terminal 5E, the contact piece 6, and the terminal 5A are electrically connected. Namely, a first terminal group (terminals 5E, 5A) is electrically connected.

When the knob 3 continues to slide more to the right in FIG. 6A to the state shown in FIG. 6B, the projection 4C of the slider 4 abuts against the click spring 7A. In result, the force necessary for the slide operation of the knob 3 increases sharply. At this time, the left end of the contact piece 6 is brought into contact with the terminal 5E in a position 5E1, and the right end part of the contact piece 6 is brought into contact with the terminal 5A in a position 5A1. In other words, the terminal 5E, the contact piece 6, and the terminal 5A are electrically connected, and the first terminal group (terminals 5E, 5A) is electrically connected. Namely, with abutting of the projection 4C of the slider 4 against the click spring 7A, the force necessary for the slide operation of the knob 3 increases sharply, whereby the operator of the push slide switch can recognize that the first terminal group (terminals 5E, 5A) has been electrically connected.

When the knob 3 continues to slide more to the right in FIGS. 6A and 6B to the state shown in FIG. 6C, the convex click spring 7A is recessed by the projection 4C of the slider 4. Specifically, as the knob 3 continues to slide, the recessed quantity of the click spring 7A increases, so that the force necessary for the slide operation of the knob 3 increases more. Next, as the knob 3 continues to slide more, the recessed quantity of the click spring 7A increases more, so that the force necessary for the slide operation of the knob 3 decreases sharply. At this time, the left end part of the contact piece 6 is brought into contact with the terminal 5E in a position 5E2, and the right end part of the contact piece 6 is brought into contact with the terminal 5A in a position 5A2. Further, at this time, the click spring 7A electrically connected to the terminal 5A is also brought into contact with the terminal 5B arranged on the back surface of the click spring 7A in a position 5B2, and the click spring 7A is electrically connected to the terminal 5B. In other words, the terminal 5E, the contact piece 6, the terminal 5A, the click spring 7A, and the terminal 5B are electrically connected, so that a second terminal group (terminals 5E, 5A and 5B) is electrically connected. Namely, as the recessed quantity of the click spring 7A by the projection 4C of the slider 4 becomes larger, the force necessary for the slide operation of the knob 3 decreases sharply, whereby the operator of the push slide switch can recognize that the second terminal group (terminals 5E, 5A, and 5B) has electrically connected.

On the other hand, when the knob 3 is slid from the state shown in FIG. 6A to the left in FIG. 6A, the slider 4 is also slid to the left in FIG. 6A integrally with the knob 3. Hereby, the coil spring 8 starts to be compressed. Specifically, the coil spring 8 comes to be supported by the coil spring holding part 1G of the housing 1 and the coil spring holding part 4E of the slider 4. Namely, the left end part of the coil spring 8 comes to be supported by the coil spring holding part 1G of the housing 1, and the right end part of the coil spring 8 comes to be supported by the coil spring holding part 4E of the slider 4. As the knob 3 continues to slide to the left in FIG. 6A, the force for the slide operation of the knob 3 increases gradually with increase of the slide quantity of the knob 3.

When the knob 3 continues to slide more to the left in FIG. 6A, the left end part of the contact piece 6 attached to the knob 3 is brought into contact with the terminal 5G. In other words, the terminal 5E, the contact piece 6, and the terminal 5G are electrically connected. Namely, a third terminal group (terminals 5E, 5A) is electrically connected.

When the knob 3 continues to slide more to the left in FIG. 6A to the state shown in FIG. 6D, the projection 4D of the slider 4 abuts against the click spring 7B. In result, the force necessary for the slide operation of the knob 3 increases sharply. At this time the right end of the contact piece 6 is brought into contact with the terminal 5E in a position 5E3, and the left end part of the contact piece 6 is brought into contact with the terminal 5G in a position 5G3. In other words, the terminal 5E, the contact piece 6, and the terminal 5G are electrically connected, and the third terminal group (terminals 5E, 5G) is electrically connected. Namely, with abutting of the projection 4D of the slider 4 against the click spring 7B, the force necessary for the slide operation of the knob 3 increases sharply, whereby the operator of the push slide switch can recognize that the third terminal group (terminals 5E, 5G) has been electrically connected.

When the knob 3 continues to slide more to the left in FIG. 6A and FIG. 6D to the state shown in FIG. 6E, the convex click spring 7B is recessed by the projection 4D of the slider 4. Specifically, as the knob 3 continues to slide, the recessed quantity of the click spring 7B increases, so that the force necessary for the slide operation of the knob 3 increases more. Next, as the knob 3 continues to slide more, the recessed quantity of the click spring 7B increases more, so that the force necessary for the slide operation of the knob 3 decreases sharply. At this time, the right end part of the contact piece 6 is brought into contact with the terminal 5E in a position 5E4, and the left end part of the contact piece 6 is brought into contact with the terminal 5G in a position 5G4. Further, at this time, the click spring 7B electrically connected to the terminal 5G is also brought into contact with the terminal 5F in a position 5F4, and the click spring 7A is electrically connected to the terminal 5F. In other words, the terminal 5E, the contact piece 6, the terminal 5G, the click spring 7B, and the terminal 5F are electrically connected, so that a fourth terminal group (terminals 5E, 5G and 5F) is electrically connected. Namely, as the recessed quantity of the click spring 7B by the projection 4D of the slider 4 becomes larger, the force necessary for the slide operation of the knob 3 decreases sharply, whereby the operator of the push slide switch can recognize that the fourth terminal group (terminals 5E, 5G, and 5F) has been electrically connected.

Figure 7A:
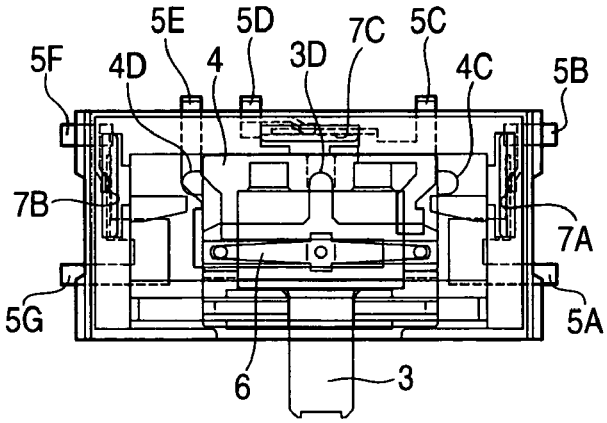
FIGS. 7A to 7C are diagrams showing the state where the knob 3 is push-moved upward in FIGS. 1A and 4A.
Figure 7B:
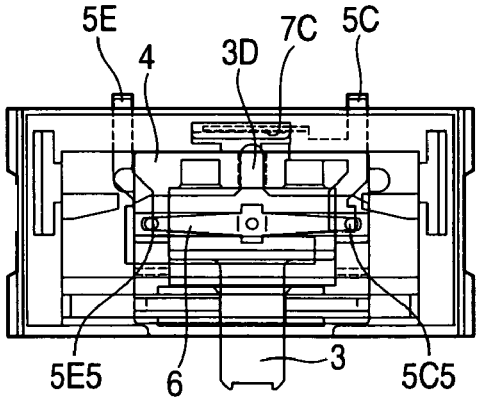
Figure 7C:
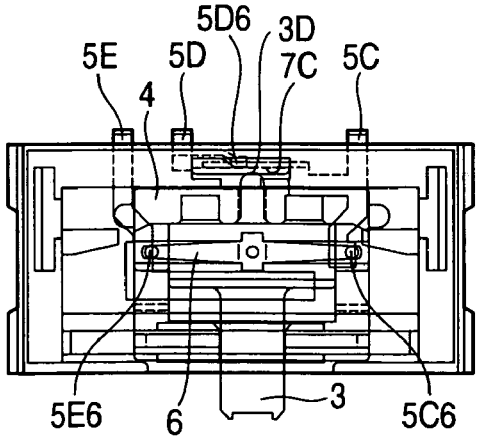

FIGS. 7A to 7C are diagrams showing the state where the knob 3 is push-moved upward in FIGS. 1A and 4A. Specifically, FIG. 7A is a diagram showing the push slide switch when the knob 3 is arranged in the home position, that is, when the operator does not operate the knob 3. FIG. 7B is a diagram showing the push slide switch when the knob 3 is push-moved upward in FIGS. 1A, 4A, and 7A till the projection 3D of the knob 3 abuts against the click spring 7C. FIG. 7C is a diagram showing the push slide switch when the knob 3 is more push-moved upward in the FIGS. 1A, 4A, and 7B till the force necessary for the push operation of the knob 3 decreases sharply.

In the state shown in FIG. 7A, that is, in the state where the knob 3 is arranged in the home position, as described above, the contact piece 6 is not brought into contact with other terminals 5A, 5B, 5C, 5D, 5F, and 5G than the terminal 5E. Namely, the terminals 5A, 5B, 5C, 5D, 5E, 5F, and 5G are separated electrically from one another, and the terminals 5A, 5B, 5C, 5D, 5E, 5F, and 5G are disconnected electrically to one another. In this state, an upper end part (refer to FIG. 1A) of the coil spring 9A is supported by the coil spring holding part 4G of the slider 4 (refer to FIG. 5A), and a lower end part (refer to FIG. 1A) of the coil spring 9A is supported by the coil spring holding part 3E of the knob 3. Further, an upper end part (refer to FIG. 1A) of the coil spring 9B is supported by the coil spring holding part 4H of the slider 4 (refer to FIG. 5A), and a lower end part (refer to FIG. 1A) of the coil spring 9B is supported by the coil spring holding part 3F of the knob 3 (refer to FIG. 4A).

Next, when the knob 3 is push-moved from the state shown in FIG. 7A upward in FIG. 7A, it is moved upward in FIG. 7A in relation to the housing 1 and the slider 4. Hereby, the coil springs 9A and 9B start to be compressed. As the knob 3 continues to be push-moved upward in FIG. 7A, the force necessary for the push operation of the knob 3 increases gradually with increase of the push quantity of the knob 3.

When the knob 3 continues to be push-moved more upward in FIG. 7A, the right end part of the contact piece 6 attached to the knob 3 is brought into contact with the terminal 5C. In other words, the terminal 5E, the contact piece 6, and the terminal 5C are electrically connected. Namely, a fifth terminal group (terminals 5E, 5C) is electrically connected.

When the knob 3 continues to be push-moved more upward in FIG. 7A to the state shown in FIG. 7B, the projection 3D of the knob 3 abuts against the click spring 7C. In result, the force necessary for the push operation of the knob 3 increases sharply. At this time, the left end of the contact piece 6 is brought into contact with the terminal 5E in a position 5E5, and the right end part of the contact piece 6 is brought into contact with the terminal 5C in a position 5C5. In other words, the terminal 5E, the contact piece 6, and the terminal 5C are electrically connected, and the fifth terminal group (terminals 5E, 5C) is electrically connected. Namely, with abutting of the projection 3D of the knob 3 against the click spring 7C, the force necessary for the push operation of the knob 3 increases sharply, whereby the operator of the push slide switch can recognize that the fifth terminal group (terminals 5E, 5C) has been electrically connected.

When the knob 3 continues to be push-moved more upward in FIGS. 7A and 7B to the state shown in FIG. 7C, the convex click spring 7C is recessed by the projection 3D of the knob 3. Specifically, as the knob 3 continues to be push-moved, the recessed quantity of the click spring 7C increases, so that the force necessary for the push operation of the knob 3 increases more. Next, as the knob 3 continues to be push-moved more, the recessed quantity of the click spring 7C increases more, so that the force necessary for the push operation of the knob 3 decreases sharply. At this time, the left end part of the contact piece 6 is brought into contact with the terminal 5E in a position 5E6, and the right end part of the contact piece 6 is brought into contact with the terminal 5C in a position 5C6. Further, at this time, the click spring 7C electrically connected to the terminal 5C is also brought into contact with the terminal 5D arranged on the back surface of the click spring 7C in a position 5D6, and the click spring 7C is electrically connected to the terminal 5D. In other words, the terminal 5E, the contact piece 6, the terminal 5C, the click spring 7C, and the terminal 5D are electrically connected, so that a sixth terminal group (terminals 5E, 5C and 5D) is electrically connected. Namely, as the recessed quantity of the click spring 7C by the projection 3D of the knob 3 becomes larger, the force necessary for the push operation of the knob 3 decreases sharply, whereby the operator of the push slide switch can recognize that the sixth terminal group (terminals 5E, 5C, and 5D) has been electrically connected.

In the push slide switch of the first embodiment, as shown in FIG. 1B, the convex click spring 7A having the characteristic that as displacement level (elastic deformation quantity, recessed quantity) thereof is increased, stress thereof increases, and as the displacement level (elastic deformation quantity, recessed quantity) is more increased, the stress decreases sharply is provided. The click spring 7A is arranged so that the force necessary for slide operation of the knob 3 to the right (refer to FIG. 6C) decreases sharply when the second terminal group (terminals 5E, 5A, and 5B) is electrically connected as shown in FIG. 6C. Therefore, by the sharp decrease of the force necessary for slide operation of the knob 3 to the right, the operator can recognize that the second terminal group (terminals 5E, 5A, and 5B) has been electrically connected.

Further, in the push slide switch of the first embodiment, as shown in FIG. 1B, the convex click spring 7B having the characteristic that as the displacement level (elastic deformation quantity, recessed quantity) thereof is increased, stress thereof increases, and as the displacement level (elastic deformation quantity, recessed quantity) is more increased, the stress decreases sharply is provided. The click spring 7B is arranged so that: when the fourth terminal group (terminals 5E, 5G, and 5F) is electrically connected as shown in FIG. 6E, the force necessary for the slide operation of the knob 3 to the left (refer to FIG. 6E) decreases sharply. Therefore, by the sharp decrease of the force necessary for slide operation of the knob 3 to the left, the operator can recognize that the fourth terminal group (terminals 5E, 5G, and 5F) has been electrically connected.

Further, in the push slide switch of the first embodiment, as shown in FIG. 1C, the convex click spring 7C having the characteristic that as the displacement level (elastic deformation quantity, recessed quantity) thereof is increased, stress thereof increases, and as the displacement level (elastic deformation quantity, recessed quantity) is more increased, the stress decreases sharply is provided. The click spring 7C is arranged so that: when the sixth terminal group (terminals 5E, 5C, and 5D) is electrically connected as shown in FIG. 7C, the force necessary for the upward push operation of the knob 3 (refer to FIG. 7C) decreases sharply. Therefore, by the sharp decrease of the force necessary for the upward push operation of the knob 3, the operator can recognize that the sixth terminal group (terminals 5E, 5C, and 5D) has been electrically connected.

Further, in the push slide switch of the first embodiment, as shown in FIGS. 1B and 2B, the click springs 7A and 7B are arranged on the wall surfaces 1B and 1D of the housing 1. Specifically, on the wall surfaces 1B and 1D being inclined with respect to the bottom surface 1A of the housing 1, the click springs 7A and 7B are arranged. More specifically, on the wall surfaces 1B and 1D standing at an angle of 60° to 85° to the bottom surface 1A of the housing 1, the click springs 7A and 7B are arranged, and in the inclined standing wall surfaces 1B and 1D, the terminals 5B and 5F are insert-molded.

Further, in the push slide switch of the first embodiment, as shown in FIGS. 1C and 2C, the click spring 7C is arranged on the wall surface 1C of the housing 1. Specifically, on the wall surface 1C being inclined with respect to the bottom surface 1A of the housing 1, the click spring 7C is arranged. More specifically, on the wall surface 1C standing at an angle of 60° to 85° to the bottom surface 1A of the housing 1, the click spring 7C is arranged, and in the inclined standing wall surface 1C, the terminal 5D is insert-molded.

Further, in the push slide switch of the first embodiment, when the knob 3 is slid from the home position shown in FIG. 6A to the right, the first terminal group (terminals 5E and 5A) is electrically connected as shown in FIG. 6B; and when the knob 3 is slid more to the right, the second terminal group (terminals 5E, 5A and 5B) are electrically connected as shown in FIG. 6C. On the other hand, when the knob 3 is slid from the home position shown in FIG. 6A to the left, the third terminal group (terminals 5E and 5G) is electrically connected as shown in FIG. 6D; and when the knob 3 is slid more to the left, the fourth terminal group (terminals 5E, 5G and 5F) is electrically connected as shown in FIG. 6E. In other words, the state (FIG. 6A) where the knob 3 is arranged in the home position and the terminals 5A, 5B, 5C, 5D, 5E, 5F, and 5G are not connected electrically, the state (FIG. 6B) where the knob 3 is slid to the right and the first terminal group (terminals 5E and 5A) is electrically connected, the state (FIG. 6C) where the knob 3 is slid more to the right and the second terminal group (terminals 5E, 5A and 5B) is electrically connected, the state (FIG. 6D) where the knob 3 is slid to the left and the third terminal group (terminals 5E and 5G) is electrically connected, and the state (FIG. 6E) where the knob 3 is slid more to the left and the fourth terminal group (terminals 5E, 5G and 5F) is electrically connected are switched by the slide operation of the knob 3. Namely, the five terminal connection states are switched by the slide operation of the knob 3.

Further, in the push slide switch of the first embodiment, when the knob 3 is slid from the home position shown in FIGS. 6A and 7A upward, the fifth terminal group (terminals 5E and 5C) is electrically connected as shown in FIG. 7B; and when the knob 3 is push-moved more upward, the sixth terminal group (terminals 5E, 5C and 5D) is electrically connected as shown in FIG. 7C. Namely, the state (FIG. 7B) where the knob 3 is push-moved upward and the fifth terminal group (terminals 5E and 5C) is electrically connected, and the state (FIG. 7C) where the knob 3 is push-moved more upward and the sixth terminal group (terminals 5E, 5C and 5D) is electrically connected are switched by the push operation of the knob 3.

Further, in the push slide switch of the first embodiment, the click spring 7C is arranged so that the force necessary to push-move the knob 3 upward in order to connect the sixth terminal group (terminals 5E, 5C and 5D) electrically becomes larger than the force necessary to push-move the knob 3 to the right in order to connect the second terminal group (terminals 5E, 5A and 5B) electrically, and the force necessary to push-move the knob 3 to the left in order to connect the fourth terminal group (terminals 5E, 5G and 5F) electrically. Specifically, the elastic coefficient of the click spring 7C for causing the operator to recognize that the sixth terminal group (terminals 5E, 5C and 5D) has been electrically connected is set to a larger value than the elastic coefficient of the click spring 7A for causing the operator to recognize that the second terminal group (terminals 5E, 5A and 5B) has been electrically connected, and the elastic coefficient of the click spring 7B for causing the operator to recognize that the fourth terminal group (terminals 5E, 5G and 5F) has been electrically connected. Therefore, when the knob 3 is push-moved to the right or the left, it is possible to prevent the sixth terminal group (terminals 5E, 5C and 5D) from being electrically connected erroneously.

The push slide switch of the first embodiment is used in, for example, switching of menu in a portable audio and determination of menu. Specifically, for example, when the first terminal group (terminals 5E and 5A) is electrically connected, an item included in a first menu is scrolled and selected; when the second terminal group (terminals 5E, 5A and 5B) is electrically connected, its selected item is determined; when the third terminal group (terminals 5E and 5G) is electrically connected, an item included in a second menu is scrolled and selected; and when the fourth terminal group (terminals 5E, 5G and 5F) is electrically connected, its selected item is determined. Further, when the fifth terminal group (terminals 5E and 5C) is electrically connected, an item included in a third menu is scrolled and selected; and when the sixth terminal group (terminals 5E, 5C and 5D) is electrically connected, its selected item is determined.

As described above, in the first embodiment, the push slide switch of the invention is applied to, for example, a portable audio, and the push slide switch of the invention can be applied to another arbitrary electric appliance.

What is claimed is:

1. A slide switch comprising:

a housing;

a knob that is slidably provided in the housing;

a plurality of terminals that are disposed in the housing; and a click spring that is disposed in the housing, and has a characteristic that as a displacement level thereof is increased, stress thereof increases, and as the displacement level is further increased, the stress decreases sharply, wherein the click spring is arranged so that force for operating the knob decreases sharply when the terminals are electrically connected to each other, wherein the click spring is arranged so that:

when the knob is slid in a direction and abuts against the click spring directly or indirectly, the force increases sharply with its abutting, and a first group of the terminals are electrically connected to each other;

when the knob is slid more in the direction, the force increases more and reaches a peak; and when the force decrease sharply, a second group of the terminals are electrically connected to each other.

2. A slide switch according to claim 1, wherein when the knob is slid in a first direction from a home position of the housing, which is a substantially center position in the direction, a first group of the terminals are electrically connected to each other, when the knob is slid more in the first direction, a second group of the terminals are electrically connected to each other, when the knob is slid in a second direction opposed to the first direction from the home position, a third group of the terminals are electrically connected to each other, and when the knob is slid more in the second direction, a fourth group of the terminals are electrically connected to each other.

3. A slide switch according to claim 2, wherein when the knob is push-moved in a third direction perpendicular to the first direction from the home position, a fifth group of the terminals are electrically connected to each other, and when the knob is push-moved more in the third direction, a sixth group of the terminals are electrically connected to each other.

4. A slide switch according to claim 3, wherein the housing includes a plurality of the click spring, and wherein the click springs are arranged so that force for operating the knob in the third direction in order to connect the sixth group of the terminals becomes larger than force for operating the knob in the first direction in order to connect the second group of the terminals and in the second direction in order to connect the fourth group of the terminals.

5. A slide switch according to claim 1, wherein the click spring is arranged on a wall surface of the housing, which is perpendicular to a direction in which the knob is slid.

6. A slide switch according to claim 5, wherein the wall surface is inclined with respect to a bottom surface of the housing, which is parallel to the direction.

7. A slide switch according to claim 1, wherein the click spring is a convex-shaped conductive plate spring material.

8. A slide switch according to claim 7, wherein the click spring is arranged on a wall surface of the housing, which is perpendicular to a direction in which the knob is slid.

9. A slide switch comprising:

a housing;

a knob that is slidably provided in the housing; and a first switching unit that includes:

a first group of terminals that are disposed in the housing; and a click spring that is arranged in the housing, wherein the knob is slidable in a sliding direction from a home position of the housing, which is a substantially center position in the sliding direction, to first and second positions that are arranged in this order from the home position to the click spring in the sliding direction, wherein when the knob is moved to the first position and abuts against the click spring, force for operating the knob increases sharply, wherein when the knob is moved from the first position to the second position, the force decrease sharply, and the first group of the terminals are electrically connected to each other, wherein the first switching unit includes a second group of terminals that are disposed in the housing, wherein a third position, at which the knob abuts against the click spring, is set between the home and first positions, wherein when the knob abuts against the click spring and is set at the third position, the force increases sharply, and the second group of the terminals are electrically connected to each other, wherein when the knob is moved from the third position to the first position, the force increases more, and wherein when the knob is moved from the first position to the second position, the force decrease sharply, and the first group of the terminals are electrically connected to each other.

10. A slide switch according to claim 9, further comprising a second switching unit having a same structure as the first switching unit, the second switching unit being disposed opposite to the first switching unit with respect to the home position.

11. A slide switch according to claim 10, further comprising a third switching unit having the same structure as the first switching unit, the third switching unit being disposed between the first and second switching units.

12. A slide switch according to claim 11, wherein the knob is slidable in a direction perpendicular to the sliding direction.

13. A slide switch according to claim 12, wherein the click springs are arranged so that the force for operating the knob in the direction in order to connect the first group of the terminals of the third switching unit becomes larger than the force for operating the knob in the sliding direction in order to connect the first groups of the terminals of the first and second switching units.

14. A slide switch according to claim 9, wherein the click spring is arranged on a wall surface of the housing, which is perpendicular to a direction in which the knob is slidable.

15. A slide switch according to claim 14, wherein the wall surface is inclined with respect to a bottom surface of the housing, which is parallel to the direction.

16. A slide switch according to claim 9, wherein at least one of the terminals of the first group is common to at least one of the terminals of the second group.

17. A slide switch according to claim 9, wherein the click spring is a convex-shaped conductive plate spring material.

18. A slide switch according to claim 17, wherein the click spring is arranged on a wall surface of the housing, which is perpendicular to a direction in which the knob is slidable.

* * * * *

UNITED STATES PATENT AND TRADEMARK OFFICE

CERTIFICATE OF CORRECTION

PATENT NO. : 7,211,757 B2
APPLICATION NO. : 11/135598
DATED : May 1, 2007
INVENTOR(S) : Masataka Maehara It is certified that error appears in the above-identified patent and that said Letters Patent is hereby corrected as shown below:

On the Title Page, under section (56) FOREIGN PATENT DOCUMENTS please delete "2000-311511", and insert therefor --2000 - 311551--

Signed and Sealed this

Eleventh Day of September, 2007

JON W. DUDAS
*Director of the United States Patent and Trademark Office*